US008699894B2

(12) United States Patent
Kawata et al.

(10) Patent No.: US 8,699,894 B2
(45) Date of Patent: Apr. 15, 2014

(54) IMAGE FORMING APPARATUS

(75) Inventors: Kentarou Kawata, Suntou-gun (JP); Motoki Adachi, Ashigarakami-gun (JP); Takayuki Kanazawa, Suntou-gun (JP); Masanori Tanaka, Mishima (JP); Shunsuke Mizukoshi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 13/211,193

(22) Filed: Aug. 16, 2011

(65) Prior Publication Data

US 2012/0045225 A1 Feb. 23, 2012

(30) Foreign Application Priority Data

Aug. 19, 2010 (JP) ..... 2010-184282

(51) Int. Cl.
*G03G 15/08* (2006.01)

(52) U.S. Cl.
USPC ..... 399/27; 399/227

(58) Field of Classification Search
USPC ..... 399/27
See application file for complete search history.

(56) References Cited

U.S. PATENT DOCUMENTS

| | | | | |
|---|---|---|---|---|
| 6,587,650 | B2 * | 7/2003 | Yokoi et al. | 399/27 |
| 7,853,179 | B2 * | 12/2010 | Nishi | 399/227 |
| 8,155,539 | B2 * | 4/2012 | Kawasaki et al. | 399/27 |
| 2009/0317138 | A1 * | 12/2009 | Kawasaki et al. | 399/227 |
| 2013/0163999 | A1 * | 6/2013 | Isobe et al. | 399/12 |
| 2013/0164001 | A1 * | 6/2013 | Isobe et al. | 399/27 |

FOREIGN PATENT DOCUMENTS

| | | | |
|---|---|---|---|
| JP | 4-234777 | A | 8/1992 |
| JP | 2010-026497 | A | 2/2010 |

* cited by examiner

*Primary Examiner* — Walter L Lindsay, Jr.
*Assistant Examiner* — Philip Marcus T Fadul
(74) *Attorney, Agent, or Firm* — Canon USA Inc IP Division

(57) ABSTRACT

In a rotary-type image forming apparatus in which detection of electrostatic capacitance is performed when a developing apparatus is in a posture less affected by a toner density within the developing apparatus, a toner in the developing apparatus, which is located at a development position during the detection of the electrostatic capacitance, is avoided from being uselessly consumed. The image forming apparatus has a remaining amount detection mode of detecting a toner remaining amount on condition that a developing roller of one developing apparatus positioned opposite to another developing apparatus, for which the toner remaining amount is to be detected, stands by in a state spaced from a drum.

9 Claims, 13 Drawing Sheets

IMAGE FORMING APPARATUS

BACKGROUND OF THE INVENTION

1. Field of the Invention

The present invention relates to an image forming apparatus of electrophotographic type or electrostatic recording type. More particularly, the present invention relates to an image forming apparatus configured to form an image on a recording medium, the apparatus including an image bearing member for bearing an electrostatic latent image on its surface, such as an electrophotographic photosensitive member or an electrostatic recording dielectric, and a developing apparatus for developing the electrostatic latent image with a developer (hereinafter referred to also as a "toner").

2. Description of the Related Art

Japanese Patent Laid-Open No. 4-234777 discloses a method of detecting the amount of a toner remaining in a developing apparatus. The developing apparatus described in Japanese Patent Laid-Open No. 4-234777 includes a toner bearing member for supplying the toner to the toner bearing member and developing an electrostatic latent image, and a toner supply member held in contact with the toner bearing member and supplying the toner to the toner bearing member. In that developing apparatus, the amount of the remaining toner is detected by applying an alternating voltage to the toner bearing member from a development bias power supply, and by detecting a voltage induced in a core metal of the toner supply member. In other words, the electrostatic capacitance between the toner bearing member and the core metal differs depending on states of the remaining toner, i.e., a state where the toner is sufficiently present in the developing apparatus in such an amount as filling a space between the toner bearing member and the core metal, and a state where the toner is consumed with repeated image formations and the amount of the toner between the toner bearing member and the core metal is reduced. The above-described method enables the amount of the remaining toner to be detected without needing an extra space.

In the above-described method of detecting the amount of the remaining toner, however, a variation may occur in the detected electrostatic capacitance when the toner density within the developing apparatus is changed in spite of the toner being not consumed in the developing apparatus. Usually, during the image formation, the toner in the developing apparatus is sufficiently stirred and circulated with, for example, rotation of the toner bearing member and rotation of the toner supply member. On the other hand, when the developing apparatus is left unused for a long time after the end of the image formation, the toner in the developing apparatus is gradually compacted with a higher density at a position vertically approaching the bottom of a toner container downwards. Consequently, the toner density between the toner bearing member and the core metal of the toner supply member may be changed, thereby causing a variation in value of the detected electrostatic capacitance.

To solve the problem mentioned above, Japanese Patent Laid-Open No. 2010-026497 proposes a method of measuring the electrostatic capacitance between the toner bearing member and the toner supply member at a position differing from the position where the developing operation is carried out.

One example of an image forming apparatus employing the above-mentioned method will be described below with reference to FIG. 13. FIG. 13 illustrates a rotary-type image forming apparatus utilizing the technique described in Japanese Patent Laid-Open No. 2010-026497. Specifically, FIG. 13 illustrates the relative positional relationship among a photosensitive drum 1 serving as an image bearing member, four developing apparatuses 5*a* to 5*d*, and a rotary 50 serving as a developing-apparatus holder that holds the four developing apparatuses. Toners T in yellow, magenta, cyan, and black are filled respectively in the four developing apparatuses 5*a* to 5*d*. Each of the developing apparatuses 5*a* to 5*d* includes a developing roller 52 (one of 52*a* to 52*d*) serving as a toner bearing member, and an applying roller 53 (one of 53*a* to 53*d*) serving as an electroconductive support. The photosensitive drum 1 is rotatable by a controller (not shown) in the direction denoted by an arrow R1 in FIG. 13. Also, the rotary 50 is rotatable about a rotation shaft 51 in the direction denoted by an arrow R2 in FIG. 13. A rotation phase of the rotary 50 and postures of the developing apparatuses (5*a* to 5*d*) are now described. The posture of the developing apparatus at a development position where the developing roller 52 and the photosensitive drum 1 are contacted with each other is denoted by C. The posture of the developing apparatus at a position where the rotary 50 has rotated through 90° from the position corresponding to the posture C is denoted by F. The posture of the developing apparatus at a position (hereinafter referred to as an "electrostatic-capacitance detection position") where the rotary 50 has further rotated through 90° from the position corresponding to the posture F is denoted by E. The posture of the developing apparatus at a position where the rotary 50 has further rotated through 90° from the position corresponding to the posture E is denoted by G. As seen from FIG. 13, the toners T are present around the applying rollers 53*a*, 53*b* and 53*d* when the developing apparatuses are in the postures C, F and G.

In the related-art image forming apparatus described above, the electrostatic capacitance between the developing roller 52 and the applying roller 53 is detected in the electrostatic-capacitance detection position (posture E) where the toner having deposited in a nip between the developing roller 52 and the applying roller 53 during a time in which the developing apparatus 5 has been held at the development position (posture C) is fallen in the gravitational direction. Therefore, the electrostatic capacitance between the developing roller 52 and the applying roller 53 can be measured without undergoing a variation in the detected electrostatic capacitance, which may occur due to change of the toner density between the developing roller 52 and the applying roller 53.

In the image forming apparatus disclosed in Japanese Patent Laid-Open No. 2010-026497, because the detection of electrostatic capacitance is performed at the electrostatic-capacitance detection position, the developing operation of the developing apparatus at the development position can be performed, when required, at the same time as the detection of the electrostatic capacitance. For example, when a full-color image forming operation is carried out in the image forming apparatus of FIG. 13, the developing operation for yellow (developing apparatus 5*a*) and the detection of the electrostatic capacitance for cyan (developing apparatus 5*c*) can be performed at the same time. Similarly, the developing operation and the detection of the electrostatic capacitance can be performed respectively at the same time for magenta (developing apparatus 5*b*) and black (developing apparatus 5*d*), for cyan (developing apparatus 5*c*) and yellow (developing apparatus 5*a*), and for black (developing apparatus 5*d*) and magenta (developing apparatus 5*b*).

However, the developing operation and the detection of the electrostatic capacitance are not performed at the same time in some cases. In one of those cases, for example, monochromatic image formation in black is continuously repeated.

During the monochromatic image formation, the developing apparatus 5*d* performs the developing operation at the development position, but the amount of the remaining toner cannot be detected at the development position. In order to detect the amount of the toner remaining in the developing apparatus 5*d*, therefore, the rotary 50 needs to be rotated through 180° and moved to the electrostatic-capacitance detection position at a predetermined timing.

At the same time as when the developing apparatus 5*d* is moved to the electrostatic-capacitance detection position, the developing apparatus 5*b* for magenta is moved to the development position and is brought into contact with the photosensitive drum 1 to be ready for the developing operation. In the monochromatic image formation, however, because the developing apparatus 5*b* for magenta is not required to perform the developing operation, the developing apparatus 5*b* is stopped at the development position in the state contacting with the photosensitive drum 1 to wait for the end of the detection of the electrostatic capacitance in the developing apparatus 5*d* for black.

After the end of the detection of the electrostatic capacitance in the developing apparatus 5*d* for black, the controller resumes the driving of the rotary 50 to be ready for the next image forming operation. At that time, however, the toner on the developing roller 52*b* for magenta is moved onto the photosensitive drum 1 in some cases.

Such a phenomenon may occur due to various causes, for example, that the potential of the photosensitive drum 1 is attenuated during the detection of the electrostatic capacitance in the developing apparatus 5*d* for black, and that mechanical shocks are generated upon restarting of the rotary 50.

If the toner is moved onto the photosensitive drum 1 at the undesired timing as described above, the moved toner is further moved from the photosensitive drum 1 onto a transfer material, e.g., a sheet of paper, thus generating an image failure in the form of a streak or a stripe. From the ecological point of view that has particularly become valued in recent years, useless consumption of the toner is also undesired.

SUMMARY OF THE INVENTION

In view of the problems described above, the present invention provides a rotary-type image forming apparatus in which detection of electrostatic capacitance is performed when a developing apparatus is in a posture less affected by a toner density within the developing apparatus, and in which a toner in the developing apparatus is avoided from being uselessly consumed during the detection of the electrostatic capacitance.

According to the present invention, there is provided an image forming apparatus including an image bearing member configured to bear an electrostatic latent image on a surface thereof, a plurality of developing apparatuses each including a developer containing chamber having an opening and containing a developer, a developer bearing member arranged in the opening of the developer containing chamber and including a first electrode member, the developer bearing member being configured to bear and convey the developer to the image bearing member and to develop the electrostatic latent image, and a developer supply member arranged inside the developer containing chamber in contact with the developer bearing member and including a second electrode member and a foamed layer around the second electrode member, the developer supply member being configured to supply the developer to the developer bearing member, a rotatable holding unit configured to hold the developing apparatuses and to rotationally move each of the developing apparatuses to a development position where the developer bearing member and the image bearing member are contacted with each other, and a detection position where the developer having deposited in a nip between the developer bearing member and the developer supply member at the development position is dropped from the nip, and a detection device configured to be able to execute a first detection mode of detecting electrostatic capacitance between the first electrode member and the second electrode member of the developing apparatus located at the detection position in a state where any of the developing apparatuses is not located at the development position.

Further features of the present invention will become apparent from the following description of exemplary embodiments with reference to the attached drawings.

DESCRIPTION OF THE EMBODIMENTS

An embodiment of the present invention will be described in detail below, by way of example, with reference to the drawings. Be it noted that dimensions, materials, shapes, and relative positions of components described in the following embodiment should be optionally changed depending on the construction of an apparatus to which the present invention is applied and various conditions under which the present invention is employed, and that the scope of the present invention is not limited to the following embodiment.

[Embodiment]

<Overall Construction of Exemplary Image Forming Apparatus>

Figure 1:
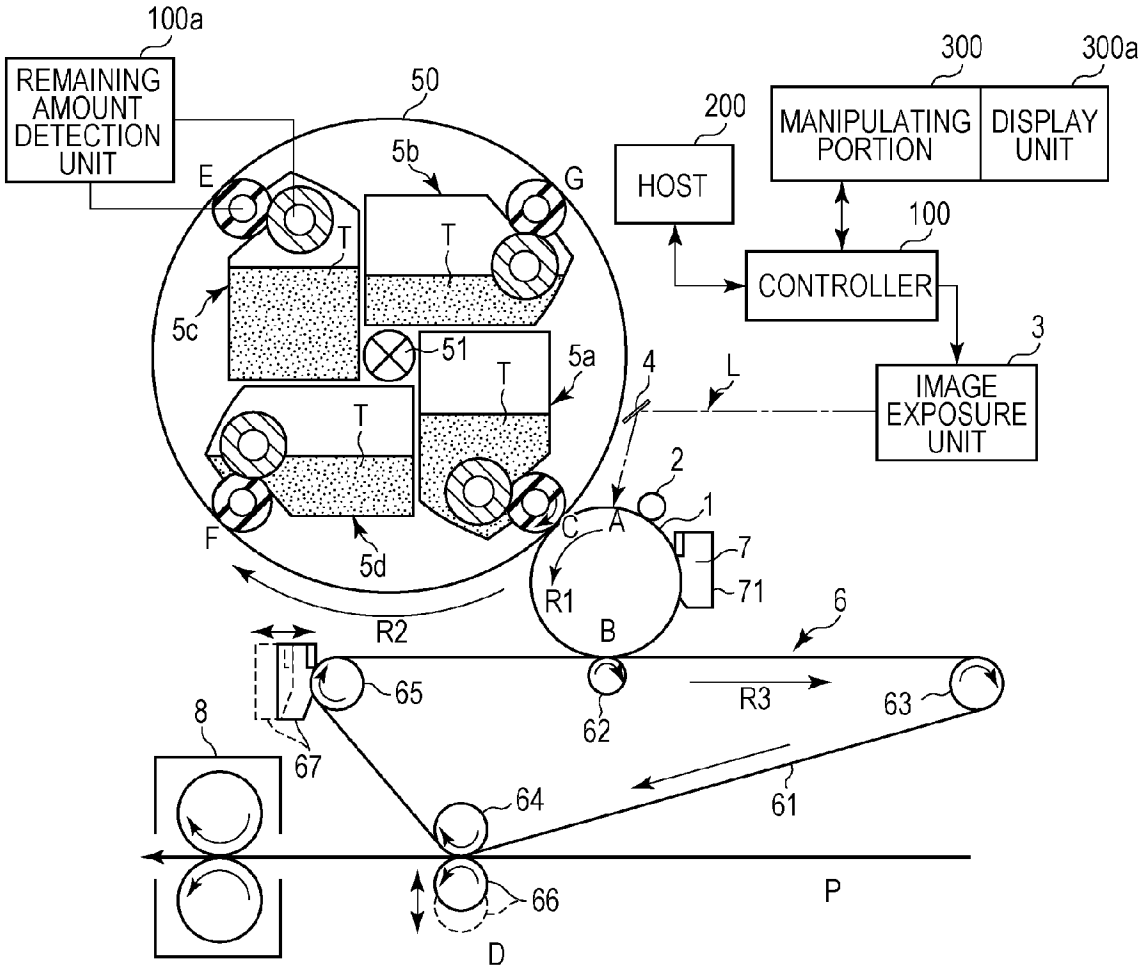
FIG. 1 is a schematic view of an image forming apparatus according to an embodiment.

FIG. 1 is a schematic view of an image forming apparatus according to an embodiment. The image forming apparatus is a four full-color image forming apparatus using an electrophotographic process. In the image forming apparatus, an image is formed on a sheet-like recording material P, which serves as a recording medium, in accordance with an electric image signal input to a controller (control unit: CPU) 100 from a host 200, e.g., an image reader (document image reading apparatus), a personal computer, or a facsimile. The controller 100 transmits and received various kinds of electrical information to and from the host 200 and a manipulating portion 300 of the image forming apparatus. Further, the controller 100 controls an image forming operation of the image forming apparatus in a supervisory manner in accordance with predetermined control programs and reference tables.

The image forming apparatus includes an electrophotographic photosensitive member (hereinafter referred to as a "drum") in the form of a rotating drum, which serves as an image bearing member for bearing an electrostatic latent image on its surface. Further, the image forming apparatus includes process units acting on the drum 1, such as a charging unit 2, an image exposure unit 3, developing units 5 (5*a*, 5*b*, 5*c* and 5*d*), a transfer unit 6, and a drum cleaning unit 7.

The drum 1 is rotated at a predetermined speed counterclockwise, as indicated by an arrow R1, about a drum axis. The charging unit 2 uniformly charges the surface of the drum 1 to a predetermined polarity (negative polarity in this embodiment) and a predetermined potential. The charging unit 2 is constituted as a contact charging roller in this embodiment. The image exposure unit 3 forms the electrostatic latent image on the surface of the drum 1, and it is constituted as a laser scanner unit in this embodiment. The image exposure unit 3 outputs a laser beam L modulated in accordance with image information for each color, which is input to the controller 100 from the host 200, and scans the laser beam L through a reflecting mirror 4 to expose the charged surface of the drum 1 at an exposure position A. As a result, the electrostatic latent image is formed on the surface of the drum 1. In this embodiment, an image exposure technique of exposing the charged drum surface in accordance with the image information is employed as an electrostatic latent image forming technique.

Each developing unit 5 visualizes, as a developer (toner) image, the electrostatic latent image formed on the drum surface. The image forming apparatus of this embodiment includes a plurality of developing units, i.e., four (first to fourth) developing apparatuses 5 (5*a*, 5*b*, 5*c* and 5*d*; called also developing cartridges). Those developing apparatuses are held on a rotary 50 serving as a developing-apparatus holder (holding unit). The rotary 50 is rotatable in an indexed manner about a central shaft 51. The developing apparatuses 5*a*, 5*b*, 5*c* and 5*d* are removably mounted to predetermined mounts (developing-apparatus mounts) that are spaced at an angular interval of 90° in the rotating direction of the rotary 50. The rotary 50 is rotated clockwise, as indicated by an arrow R2, in the indexed manner at the angular interval of 90° by a driving unit (e.g., a motor; not shown) that is controlled by the controller 100. Thus, the first to fourth developing apparatuses 5*a*, 5*b*, 5*c* and 5*d* are successively selectively moved to a development position facing the drum 1 in a predetermined relation one by one. At the development position, each developing apparatus develops the electrostatic latent image, which is formed on the surface of the drum 1, into the toner image. The rotary 50 can be rotated in the indexed manner with a resolution of 1° in terms of rotational angle as required.

Herein, the position taken by the developing apparatus 5 mounted to the rotary 50, when the relevant developing apparatus is moved to the development position facing the drum 1 in the predetermined relation, is called a "position C". The developing-apparatus position to which the developing apparatus 5 is moved from the position C with a rotation of the rotary 50 through 90° is called a "position F". The developing-apparatus position to which the developing apparatus 5 is moved from the position F with a further rotation of the rotary 50 through 90° (i.e., a rotation through 180° from the position C) is called a "position E". Further, the developing-apparatus position to which the developing apparatus 5 is moved from the position E with a further rotation of the rotary 50 through 90° (i.e., a rotation through 270° from the position C) is called a "position G".

In this embodiment, the first to fourth developing apparatuses 5*a*, 5*b*, 5*c* and 5*d* are each a reversal developing apparatus of contact development type using, as the developer T, a nonmagnetic toner with negative chargeability. Further, in this embodiment, the first developing apparatus 5*a* is a yellow developing apparatus in which a toner in a yellow (Y) color is contained in a developer containing chamber. The second developing apparatus 5*b* is a magenta developing apparatus in which a toner in a magenta (M) color is contained in a developer containing chamber. The third developing apparatus 5*c* is a cyan developing apparatus in which a toner in a cyan (Y) color is contained in a developer containing chamber. The fourth developing apparatus 5*d* is a black developing apparatus in which a toner in a black (Bk) color is contained in a developer containing chamber.

The transfer unit 6 transfers the toner image, which is formed on the surface of the drum 1, to a recording medium. The transfer unit 6 is constituted as an intermediate transfer belt unit in this embodiment. The transfer unit 6 includes, as an intermediate transfer member (first recording medium), an endless intermediate transfer belt (hereinafter referred to as a "belt") 61 that is made of a dielectric and that has flexibility. Further, the transfer unit 6 includes a primary transfer roller 62, a belt driving roller 63, a secondary transfer opposing roller 64, and a tension roller 65, which rollers cooperatively hold the belt 61 in the form of a stretched loop. The primary transfer roller 62 presses the belt 61 against the drum 1 with the belt 61 sandwiched therebetween. A contact portion between the drum 1 and the belt 61 serves as a primary transfer nip B. A secondary transfer roller 66 is disposed opposite to a portion of the secondary transfer opposing roller 64 over which the belt 61 is looped. The secondary transfer roller 66 is selectively movable by a swinging mechanism (not shown) between an operative position where the roller 66 contacts with the secondary transfer opposing roller 64 with the belt 61 sandwiched therebetween and an inoperative position where the roller 66 is spaced away from the surface of the belt 61. Usually, the secondary transfer roller 66 is held at the inoperative position. The secondary transfer roller 66 is moved to the operative position at a predetermined control timing. A contact portion between the secondary transfer roller 66 and the belt 61 in a state where the secondary transfer roller 66 is moved to the operative position serves as a secondary transfer nip D. A belt cleaning unit 67 for cleaning the surface of the belt 61 is disposed to face a region of the tension roller 65 where the belt 61 is looped over. The belt cleaning unit 67 is selectively movable by a swinging mechanism (not shown) between an operative position where a cleaning member contacts with the surface of the belt 61 and an inoperative position where the cleaning member is spaced away from the surface of the belt 61. Usually, the cleaning member is held at the inoperative position. The cleaning member is moved to the operative position at a predetermined control timing. The drum cleaning unit 7 removes, after the primary transfer of the toner image to the belt 61, the toner remaining after the primary transfer from the surface of the drum 1. The drum cleaning unit 7 is formed of a cleaning blade. The toner removed from the drum surface is contained in a cleaner container 71.

When an image formation start signal is input, the controller 100 drives a main motor (not shown). With the driving of the main motor, the drum 1 is rotated at a predetermined speed counterclockwise, as indicated by the arrow R1. Also, the rotary 50 is rotated in the indexed manner such that the first developing apparatus 5*a* is moved the position C. Further, a driving force is transmitted to the first developing apparatus 5*a*. A predetermined development bias is applied to the first developing apparatus 5*a*. The laser scanner unit 3 is driven into operation. The belt 61 is rotated clockwise (i.e., in the forward direction of the drum rotation), as indicated by an arrow R3, at a speed corresponding to the speed of the drum 1. The secondary transfer roller 66 and the belt cleaning unit 67 are already moved to and held at their inoperative positions away from the belt 61. A predetermined charging bias is applied to the charging roller 2. The surface of the rotating drum 1 is thereby uniformly charged into the predetermined polarity (negative polarity in this embodiment) and the predetermined potential. The laser beam L modulated in accordance with a Y-color component image signal of a full-color image is output from the laser scanner unit 3 to scan over the drum surface for exposure. As a result, an electrostatic latent image corresponding to the Y-color component image is formed on the drum surface. That electrostatic latent image is developed as a Y-color toner image (developer image) by the first developing apparatus 5*a* that is held at the position C. In this embodiment, the electrostatic latent image is subjected to reversal development by using a negative toner having the same polarity of the charged polarity (negative in this embodiment) of the drum 1. The Y-color toner image is primary-transferred to the surface of the belt 61 at the primary transfer nip B. A primary transfer bias having a predetermined potential and polarity (positive in this embodiment) reversed to the charged polarity of the toner is biased to the primary transfer roller 62 at a predetermined control timing. The drum surface after the primary transfer is cleaned by the drum cleaning unit 7.

When the primary transfer of the Y-color toner image to the belt 61 is completed, the rotary 50 is intermittently rotated clockwise through 90°. As a result, the second developing apparatus 5*b* is now moved to the position C. Then, the charging, exposing and developing steps are similarly executed to form, on the drum 1, an M-color toner image corresponding to an M-color component image of the full-color image. The M-color toner image is primary-transferred at the primary transfer nip B to be superimposed on the Y-color toner image, which has already been transferred to the belt 61, in a state where both the images are properly aligned with each other.

After the end of the primary transfer of the M-color toner image to the belt 61, the rotary 50 is further intermittently rotated clockwise through 90°. As a result, the third developing apparatus 5*c* is now moved to the position C. Then, the charging, exposing and developing steps are similarly executed to form, on the drum 1, a C-color toner image corresponding to a C-color component image of the full-color image. The C-color toner image is primary-transferred at the primary transfer nip B to be superimposed on the Y- and M-color toner images, which have already been transferred to the belt 61, in a state where those images are properly aligned with each other.

After the end of the primary transfer of the C-color toner image to the belt 61, the rotary 50 is further intermittently rotated clockwise through 90°. As a result, the fourth developing apparatus 5*d* is now moved to the position C. Then, the charging, exposing and developing steps are similarly executed to form, on the drum 1, a Bk-color toner image corresponding to a Bk-color component image of the full-color image. The Bk-color toner image is primary-transferred at the primary transfer nip B to be superimposed on the Y-, M- and C-color toner images, which have already been transferred to the belt 61, in a state where those images are properly aligned with each other.

As described above, a four full-color unfused toner image in Y, M, C and Bk colors is compositely formed on the belt 61.

Stated another way, the rotary 50 is intermittently rotated by the driving unit such that one developing apparatus is moved to the position C facing the drum 1 in the predetermined relation. In such a state, the electrostatic latent image formed on the drum 1 is developed into the toner image by the one developing apparatus. That operation is repetitively executed for the plural developing apparatuses by selectively changing the developing apparatus that is moved to the position C, thereby forming a full-color toner image on the belt 61.

Be it noted that the color order of the color toner images successively formed on the drum 1 is not limited to the order of Y, M, C and Bk as described above in the embodiment and the full-color tone image may be formed in an appropriately modified color order.

Before a leading end of the four full-color unfused toner image formed on the belt 61 reaches the position of the secondary transfer roller 66 with the movement of the belt 61, the secondary transfer roller 66 is moved to the operative position where it contacts with the belt 61. Further, the belt cleaning unit 67 is moved to the operative position for cleaning the belt 61.

On the other hand, one recording material P in the form of a sheet is separated and supplied as a second recording medium from a recording material supply unit (not shown) at a predetermined control timing. The recording material P is introduced by a registration roller unit (not shown) to the secondary nip D, i.e., the contact portion between the secondary transfer roller 66 and the belt 61, at a predetermined control timing. A secondary transfer bias having a predetermined potential and polarity (positive in this embodiment), which is reversed to the charged polarity of the toner, is applied to the secondary transfer roller 66. Thus, as the recording material P is progressively conveyed through the secondary transfer nip D in the state sandwiched between the secondary transfer roller 66 and the belt 61, the four-color superimposed toner image on the belt 61 is gradually secondary-transferred to the surface of the recording material P.

The recording material P is separated from the surface of the belt 61 and is introduced to a fusing unit 8 where the recording material P is heated and pressed at a fusing nip. As a result, the four-color toner image is fixed to the recording material P (through fusion color mixing). After exiting the fusing unit 8, the recording material P is discharged as a full-color image print to a discharging portion (not shown).

The residual toner after the secondary transfer, which has remained on the surface belt 61 after the separation of the recording material P from belt 61, is removed by the belt cleaning unit 67.

After the end of the image formation job for one sheet or successive plural sheets, the controller 100 returns the image forming apparatus into a standby state to wait for inputting of a next image formation start signal. In other words, the operations of the drum 1, the laser scanner unit 3, the belt 61, etc.

are stopped. Further, the secondary transfer roller 66 and the belt cleaning unit 67 are moved to their inoperative positions.

In the case of the monochromatic image formation mode, only the image formation using the fourth developing apparatus 5*d* for black is performed. After the end of the monochromatic image formation job for one sheet or successive plural sheets, the controller 100 returns the image forming apparatus into the standby state to wait for inputting of a next image formation start signal.

<Developing Apparatus 5>

In this embodiment, the first to fourth four developing apparatuses 5*a*, 5*b*, 5*c* and 5*d*, i.e., the developing units for the respective color, have the same structure just except that the colors of the developers (toners) contained in the developing apparatuses differ from each other.

Figure 2:
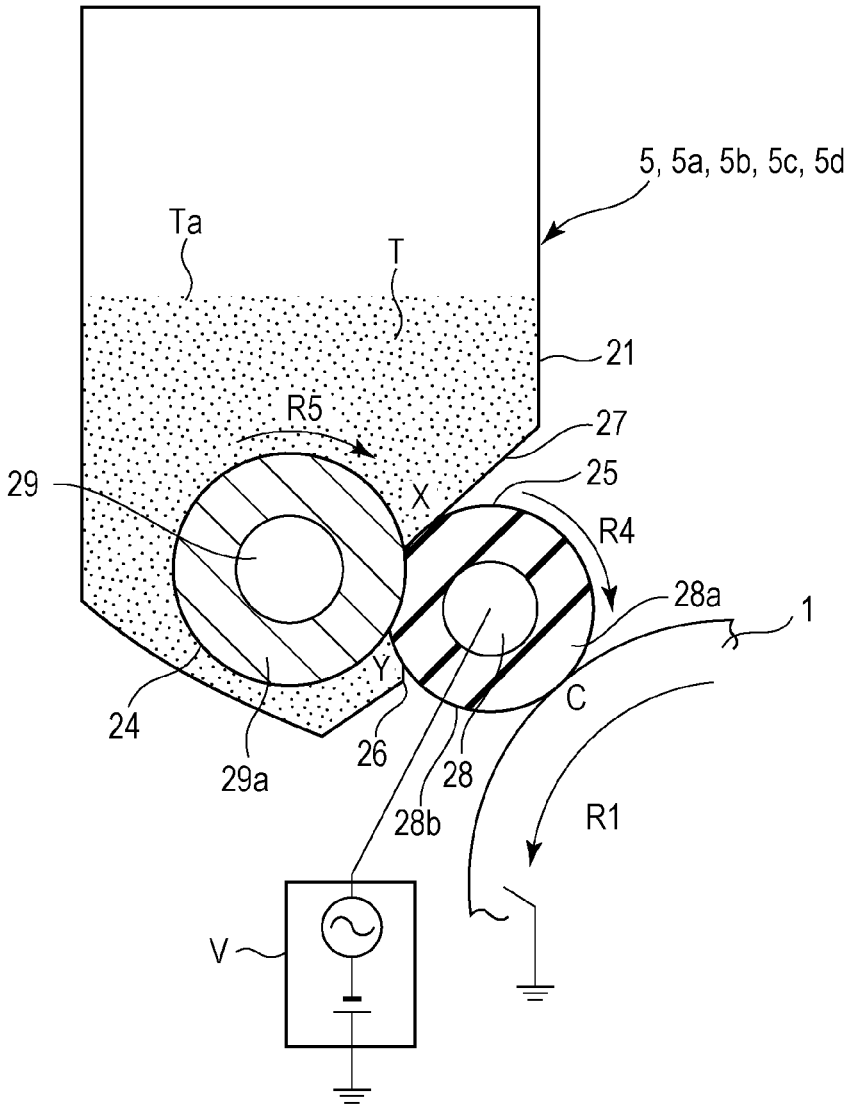
FIG. 2 is an enlarged view of a developing apparatus at a position C.

FIG. 2 is an enlarged schematic view of the developing apparatus 5 at the position C. The developing apparatus 5 includes a developer container 21 serving as a developer containing chamber in which the toner T is contained, a developing roller 25 serving as a developer bearing member that bears and transfers the toner to the electrostatic latent image formed on the drum 1, and an applying roller 24 serving as a developer supply member that contacts with the developing roller 25 and supplies the toner thereto. Further, the developing apparatus 5 includes a restricting blade 27 serving as a developer-layer thickness restricting member that restricts the thickness of a toner layer on the developing roller 25, and a leak prevention seal 26 serving to prevent the toner from leaking through a gap between the developing roller 25 and the developer container 21.

The developer container 21 is a laterally long container that is elongate in the axial direction of the drum 1. The developer container 21 has an opening that is formed at its lower portion to extend in the lengthwise direction of the container 21 and that is positioned to face the drum 1. The developing roller 25 is positioned in a state partly entering the opening and is arranged parallel to the developer container 21 in the lengthwise direction thereof. The developing roller 25 is rotatably supported to the container 21 through bearing members (not shown), which are mounted respectively at both lengthwise ends of the container 21. The applying roller 24 is arranged inside the container 21 parallel to the developing roller 25 on the reverse side of the developing roller 25 oppositely away from the side facing the drum 1. The applying roller 24 is rotatably supported to the container 21 through bearing members (not shown), which are mounted respectively at both lengthwise ends of the container 21.

In this embodiment, the developing roller 25 has a diameter of 13 mm and is constructed by forming, around an electroconductive shaft (first electrode member) 28 having a diameter of 8 mm and made of, e.g., stainless steel or an aluminum alloy, a base layer 28*a* of silicone rubber and a coating 28*b* of acrylic urethane rubber on the surface of the base layer 28*a*. The volume resistance of the developing roller 25 is 104 to 1012 Ω·cm.

The applying roller 24 is an urethane sponge roller having a diameter of 15 mm, which is obtained by forming an urethane sponge layer 29*a*, as a foamed layer made of a continuous foaming material, around an electroconductive shaft (second electrode member) 29 having a diameter of 6 mm and made of, stainless steel or an aluminum alloy. The volume resistance of the sponge layer 29*a* is 104 to 1012 Ω·cm. Thus, the applying roller 24 is made of the continuous foaming material.

The distance (center-to-center distance) between the shaft 28 of the developing roller 25 and the shaft 29 of the applying roller 24 is 13 mm. The applying roller 24 is arranged such that the urethane sponge layer 29*a* comes into the base layer 28*a* of the developing roller 25 by 1.0 mm from its surface.

The restricting blade 27 is a flexible member which is made of, e.g., phosphor bronze or urethane rubber, and which contacts at its fore end with the developing roller 25 such that the toner applied to the developing roller 25 is shaped to be coated as a thin layer thereon. The restricting blade 27 is disposed in the opening of the developer container 21 with its base end fixed to an upper edge of the opening.

The leak prevention seal 26 is a flexible member, which contacts at its fore end with the developing roller 25 and which covers a gap between a lower portion of the developing roller 25 and the developer container 21, thereby preventing the toner from leaking through the gap. The leak prevention seal 26 is disposed in the opening of the developer container 21 with its base end fixed to a lower edge of the opening.

Development of the electrostatic latent image formed on the drum 1 is started by the developing apparatus after the predetermined developing apparatus 5 has been moved to the position C (first position) facing the drum 1 in the predetermined relation, as illustrated in FIGS. 1 and 2, under indexed rotation control for the rotary 50.

In this embodiment, the developing apparatus 5 at the position C faces the drum 1 in an erect posture (first posture) where the top side of the developer container 21 is directed upwards and the bottom side thereof is directed downwards. The developing roller 25 of the developing apparatus 5 in such an erect posture contacts with the drum 1. The developing roller 25 develops the electrostatic latent image, which is formed on the drum 1, in the state contacting with the drum 1. The so-called contact development technique is thus employed.

When the image formation is executed, the driving force and the development bias input to the developing apparatus 5 at the position C from a driving unit (not shown) and a power supply unit E, respectively, which are disposed on the main body side of the image forming apparatus. The developing roller 25 is rotated at a predetermined speed clockwise as indicated by an arrow R4 in FIG. 2. Accordingly, the rotating direction of the developing roller 25 is forward, i.e., parallel, to the rotating direction R1 of the drum 1 in a contact region between the developing roller 25 and the drum 1. Also, the applying roller 24 contacting with the developing roller 25 and supplying the toner to the developing roller 25 is rotated at a predetermined speed clockwise as indicated by an arrow R5. Accordingly, the rotating direction of the applying roller 24 is backward, i.e., counter, to the rotating direction R4 of the developing roller 25 in a contact region between the applying roller 24 and the developing roller 25.

The toner is applied by the rotating applying roller 24 onto a circumferential surface of the rotating developing roller 25, and the applied toner is shaped by the restricting blade 27 to be coated as a thin layer thereon. With further rotation of the developing roller 25, the toner thin layer is moved to the position C and is applied to the surface of the drum 1. Further, a predetermined development bias, i.e., a DC voltage in this embodiment, is applied to the developing roller 25 from a development-bias power supply unit V. With the application of the predetermined development bias, the toner thin layer on the circumferential surface of the developing roller 25 is selectively shifted onto the drum surface corresponding to the electrostatic latent image on the drum surface. The electrostatic latent image is thereby developed into a toner image. The toner having been not used in the development of the electrostatic latent image is returned to the developer container 21 with further rotation of the developing roller 25. That toner is removed from the surface of the developing roller 25 by the applying roller 24, while another toner is applied to the surface of the developing roller 25 by the applying roller 24. With repetition of the above-described operation, the electrostatic latent image on the drum surface is developed.

Because the developing apparatus 5 at the position C is in the erect posture (first posture) as described above, the toner T inside the developer container 21 is present by gravity in a state biased vertically downwards, i.e., a state dropped to a lower portion of the developer container (on the side nearer to a container bottom) in which the applying roller 24 is disposed. In FIG. 2, Ta indicates a surface of the toner T (surface of the developer) contained in the developer container 21. In that posture of the developing apparatus 5, the toner T can be supplied to the applying roller 24. Therefore, the toner T can be applied to the developing roller 25. In other words, that posture represents a development enable posture where the toner T is deposited in a region X spanning from a nip (contact nip) between the developing roller 25 and the applying roller 24 to the upstream side of the applying roller 24 in the rotating direction thereof. Thus, the region X is positioned above the nip between the developing roller 25 and the applying roller 24 in the gravitational direction when the developing apparatus 5 is in the development enable posture (first position).

During the ordinary image formation, the developing apparatus 5 at the position C (i.e., the development position) is in the erect posture, and the toner T in the developer container 21 is present in the state biased vertically downwards by gravity. In particular, the toner density is high near the region X. If the toner density near the region X is reduced during the ordinary image formation, the supply of the toner to the developing roller 25 becomes insufficient and uncopied spots, etc. may be generated on the image. For that reason, during the ordinary image formation, the toner is desirably in a high density state near the region X.

The developing apparatus 5 at the position F takes a horizontal posture where the side including the developing roller 25 is directed downwards. The developing apparatus 5 at the position E takes an inverted (reversed) posture where the top and bottom sides of the developing apparatus are reversed from those in the erect posture at the position C. Further, the developing apparatus 5 at the position G takes a horizontal posture where the side including the developing roller 25 is directed upwards.

<Method of Detecting Amount of Toner Remaining in Developing Apparatus>

As the first to fourth developing apparatuses 5 (5*a*, 5*b*, 5*c* and 5*d*) are repeatedly used for the image formation, the toner contained in each of the developing apparatuses is consumed. Therefore, a remaining amount detection unit (remaining amount detection circuit) 100*a* is provided to detect the amount of the toner remaining in each of the developing apparatuses. A detected value of the remaining amount is compared with a threshold that has been previously set to give an advance notice or an alarm for the life of the developing apparatus. For the developing apparatus in which the toner remaining amount has reduced to a value lower than the threshold, an advance notice or an alarm for the life of the relevant developing apparatus is indicated on a display unit 300*a* of the manipulating portion 300. Such an indication prompts a user to prepare a new developing apparatus for replacement or to replace the developing apparatus, for the purpose of maintaining quality of an output image. The developing apparatus can be replaced with a new one by removing the spent developing apparatus from the developing-apparatus mount in the rotary 50 in accordance with predetermined procedures, and by mounting the new developing apparatus in accordance with predetermined procedures.

In this embodiment, the amount of the toner remaining in the developing apparatus is detected after changing the posture of the relevant developing apparatus 5 from the first posture to a second or third posture corresponding to the position where electrostatic capacitance is to be detected. The first posture of the developing apparatus 5 represents the posture where the development can be performed on the drum 1, i.e., the posture where the toner T can be supplied to the applying roller 24. Each of the second and third postures of the developing apparatus 5 represents the posture where the posture of the developing apparatus is changed from the first posture and the toner is returned to the developer container 21 from the applying roller 24.

The second posture and the third posture differ from each other depending on whether the developing roller 25 of one developing apparatus 5 at a position opposite to another developing apparatus 5 for which the toner remaining amount is to be detected (i.e., at a position angularly spaced through 180°-rotation of the rotary 50) is in a state contacting or not-contacting with the drum 1. In this embodiment, the second posture corresponds to the contact state, and the third posture corresponds to the non-contact state.

Figure 3:
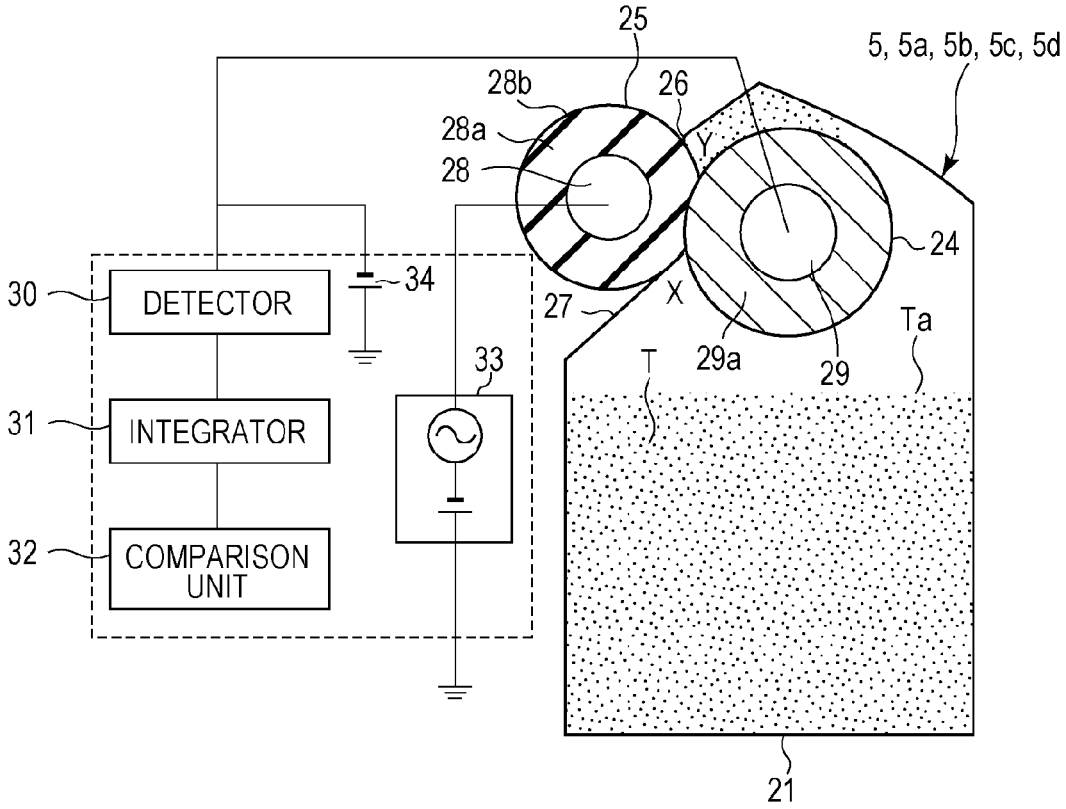
FIG. 3 is an enlarged view of the developing apparatus at a position E.

In this embodiment, the first posture of the developing apparatus 5 is defined as a posture of the developing apparatus at the position C (first position) (FIG. 2). The second posture of the developing apparatus 5 is defined as a posture of the developing apparatus at the position E (second position) (FIG. 3). Further, the third posture of the developing apparatus 5 is defined as a posture of the developing apparatus at a position (third position) (FIG. 4) where the rotary 50 has further rotated through 20° from the position E in the direction denoted by the arrow R2 in FIG. 1.

Further, in this embodiment, the detection of the toner remaining amount in the developing apparatus rotated to the second or third posture is performed as follows. An AC bias is applied to the electroconductive shaft 29 of the applying roller 24 by the remaining amount detection unit 100*a*. Then, the toner remaining amount in the developer container 21 is detected based on the voltage and the electrostatic capacitance, which are induced in the electroconductive shaft 28 of the developing roller 25. In the following description, the term "electrostatic capacitance" implies the electrostatic capacitance between the shaft 28 and the shaft 29.

When the electrostatic capacitance is measured, a measured value of the electrostatic capacitance may be changed depending on the presence of extra toner in the vicinity of the applying roller 24. This is because, if a large amount of toner is present near the applying roller 24, the electrostatic capacitance is detected corresponding to a larger amount of toner than that actually contained in the sponge layer of the applying roller 24. From the viewpoint of accurately estimating the toner amount just contained in the sponge layer of the applying roller 24, therefore, it is desired that the toner is not present near the applying roller 24.

For that reason, the detection of the toner remaining amount based on the electrostatic capacitance between the applying roller 24 and the developing roller 25 in the developing apparatus 5 is performed after changing the posture of the developing apparatus 5 from the first posture at the first position to the second posture at the second position or the third posture at the third position.

The posture of the developing apparatus 5 at the first position represents the posture where the development can be executed on the drum 1, i.e., the posture where the toner is present in the region X spanning from the nip between the applying roller 24 and the developing roller 25 to the upstream side of the applying roller 24 in the rotating direction thereof. The posture of the developing apparatus 5 at each of the second and third positions represents the position where the posture of the developing apparatus 5 is changed from the posture at the first position and the toner T is dropped from the region X. Stated another way, each of the second and third positions corresponds to the posture of the developing apparatus 5 where the toner T having deposited in the region X, which is located above the nip between the developing roller 25 and the applying roller 24 in the gravitational direction, at the first position is caused to drop from the nip.

In this embodiment, the position C in FIG. 1 is defined as the first position, and the position E is defined as the second position. Further, the position where the rotary 50 is further rotated through 20° from the position E in the direction denoted by the arrow R2 in FIG. 1 is defined as the third position. For the developing apparatus located at the second or third position, the amount of the remaining toner is detected by the remaining amount detection unit (i.e., a unit configured to detect the electrostatic capacitance between the shaft 29 of the applying roller 24 and the shaft 28 of the developing roller 25) 100*a*.

The posture of the developing apparatus 5 at the first position C, i.e., the development position, is an erect posture, while the posture of the developing apparatus 5 at the second position E is changed to an inverted posture where the top and bottom sides are reversed to those in the first position C. When the developing apparatus 5 is in the inverted posture, the toner is not present around the applying roller 24 (i.e., in the region X) as illustrated in FIG. 3. Also, when the developing apparatus 5 is in the third position where the rotary 50 is further rotated through 20° from the second position E, the toner is not present around the applying roller 24 as illustrated in FIG. 4.

Thus, at each of the second and third positions, a toner surface Ta of the toner T in the developer container 21 does not reach the applying roller 24. By setting the second or third position as the position for detecting the electrostatic capacitance, the amount of the remaining toner is detected with the remaining amount detection unit 100*a* in the developing apparatus 5 at the second or third position.

The developing apparatus at the second position E during the detection of the toner remaining amount will be described below with reference to FIG. 3. Upon the developing apparatus 5 being rotated from the position C to the position E with the rotation of the rotary 50 after the image formation, the toner in the developer container 21 of the developing apparatus 5 turned upside down is fallen to the top side. In the second position E, therefore, the electrostatic capacitance can be measured based on the amount of the toner just present in the sponge layer of the applying roller 24 without being affected by the toner near the applying roller 24.

Figure 4:
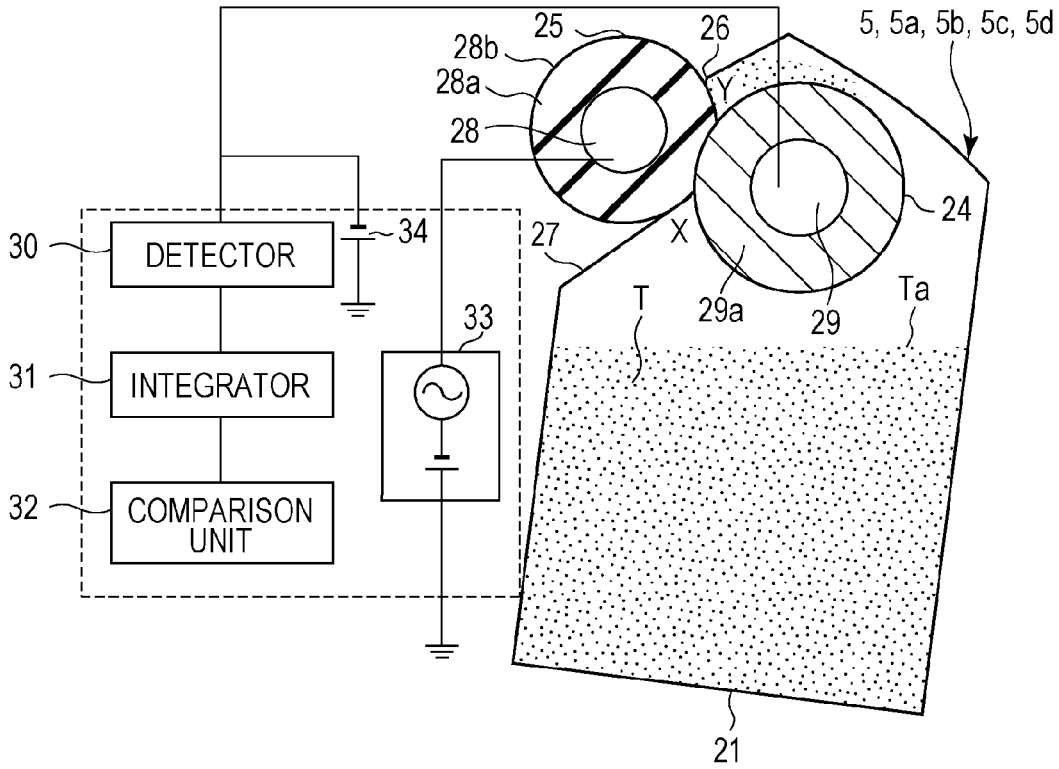
FIG. 4 is an enlarged view of the developing apparatus at a position advanced through 20° from the position E.

Further, as seen from FIG. 4, when the developing apparatus is at the third position, the electrostatic capacitance can also be measured based on the amount of the toner just present in the sponge layer of the applying roller 24 without being affected by the toner near the applying roller 24, as in the measurement of the electrostatic capacitance at the second position E.

In the state of the developing apparatus being at the second or third position, the remaining amount detection unit 100*a* applies a bias for the detection of the toner remaining amount to the electroconductive shaft 29 of the applying roller 24 from a development bias power supply 33. The bias for the detection of the toner remaining amount is provided as an AC bias with a frequency of 5 KHz and Vpp=200 V. A voltage is induced in the electroconductive shaft 28 of the developing roller 25 upon the application of the bias for the detection of the toner remaining amount, and the induced voltage is detected by a detector 30.

Figure 5:
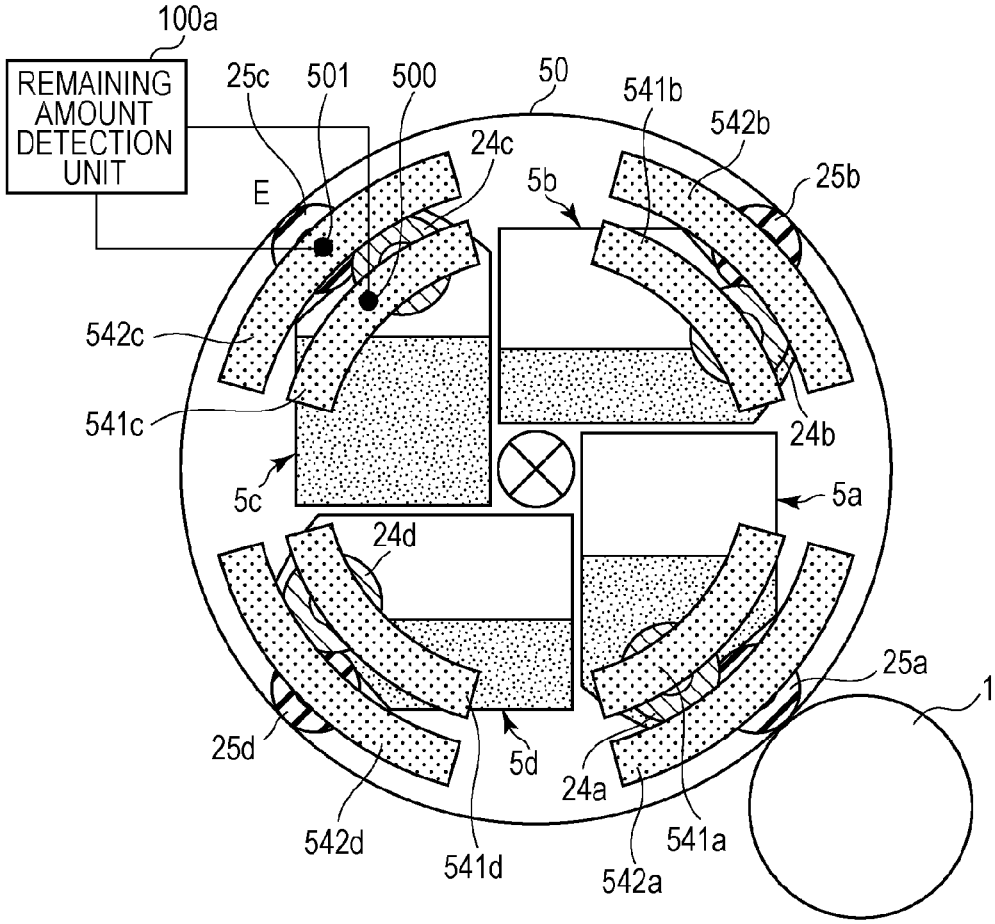
FIG. 5 is a schematic view illustrating electrical contacts in the image forming apparatuses according to the embodiment.

In the image forming apparatus of this embodiment, as illustrated in FIG. 5, an electrical contact in the main body of the image forming apparatus and an electrical contact in the developing apparatus 5, which are used to apply the bias for the detection of the toner remaining amount to the electroconductive shaft 29 of the applying roller 24 from the development bias power supply 33, are constructed such that electrical conduction can be established over a range from a point of about 30° before arrival of the developing apparatus 5 to the position E to a point of about 30° after passage of the developing apparatus 5 through the position E. Further, an electrical contact in the main body of the image forming apparatus, which is used to detect the voltage induced upon the application of the bias for the detection of the toner remaining amount by the detector 30, is also constructed similarly to the above-described electrical contacts. As a result, the electrostatic capacitance can be detected over an angular width of about 60° before and after the position E.

Reference numeral 500 denotes the electrical contact, which is disposed in the main body of the image forming apparatus and which supplies the bias for the detection of the toner remaining amount to the electroconductive shaft 29 of the applying roller 24. The electrical contact 500 is fixedly mounted at a central position in the contact range corresponding to the position E in the rotating direction of the rotary 50. Reference numeral 501 denotes the detector, which is disposed in the main body of the image forming apparatus and which detects the voltage induced upon the application of the bias for the detection of the toner remaining amount. The detector 501 is also fixedly mounted at a central position in the contact range corresponding to the position E in the rotating direction of the rotary 50.

Reference numeral 541*a* to 541*d* and 542*a* to 542*d* denote electrical contacts provided in a one-to-one relation to the developing-apparatus installed positions on the rotary 50. When the developing apparatuses are mounted, the electrical contacts 541*a* to 541*d* and 542*a* to 542*d* are brought into contact with the shafts of the applying rollers 24*a* to 24*d* and the developing rollers 25*a* to 25*d*, respectively, and the relative positional relationships between the electrical contacts and the shafts are fixedly determined. Hereinafter, the respective shafts of the applying rollers 24*a* to 24*d* and the developing rollers 25*a* to 25*d* and the electrical contacts 541*a* to 541*d* and 542*a* to 542*d* provided on the rotary 50 are regarded as being integral units and are called "contacts of the developing apparatuses 5".

Figure 6:
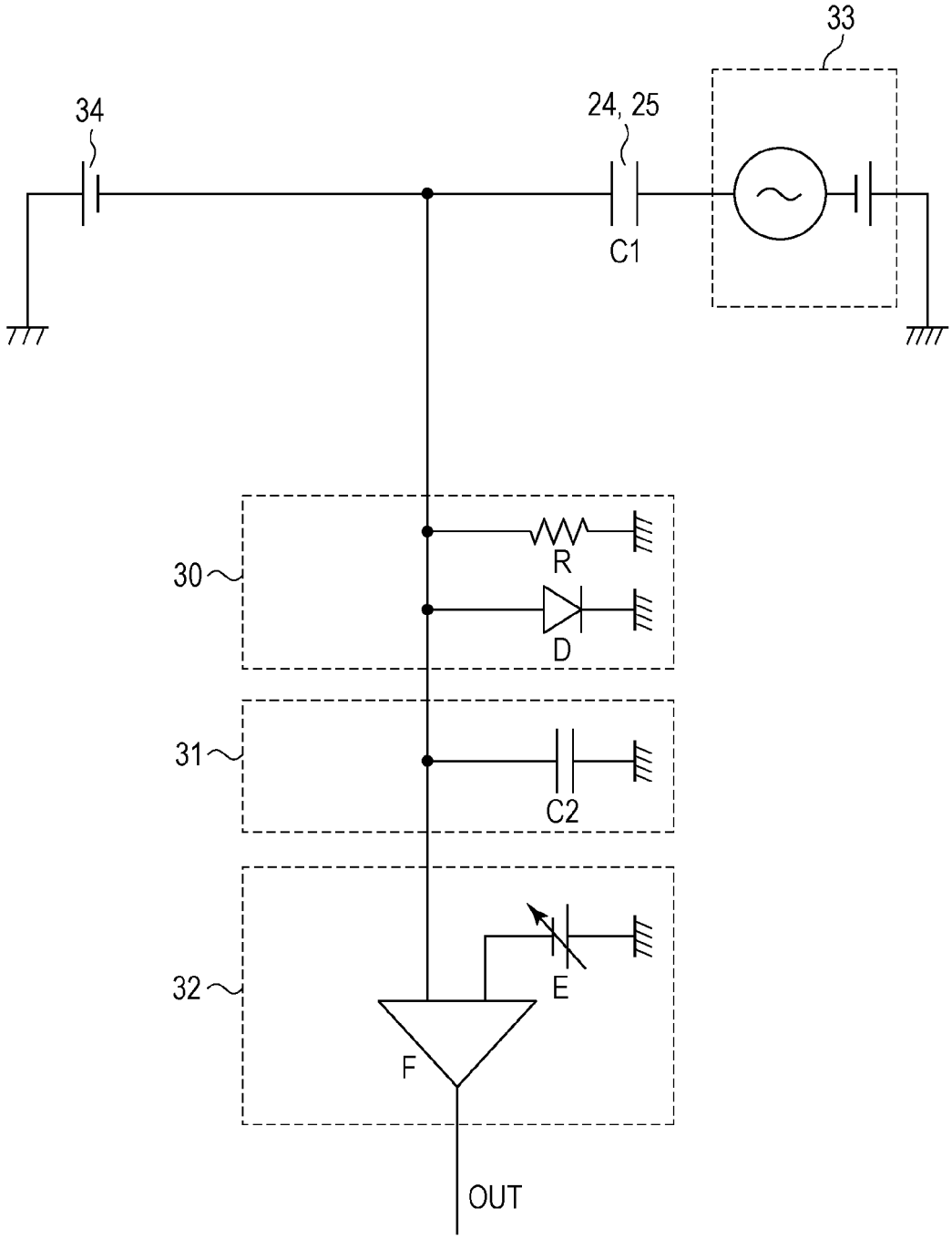
FIG. 6 is a block diagram of a toner remaining amount detection unit.

The detector 30, an integrator 31, and a comparison unit 32, which are components of the remaining amount detection unit 100*a*, will be described below. FIG. 6 is an equivalent circuit diagram including the applying roller 24 and the developing roller 25, which are represented by a capacitor C1, as well as the detector 30, the integrator 31, the comparison unit 32, the bias power supply 33 for the detection of the toner remaining amount, and the development bias power supply 34.

The bias for the detection of the toner remaining amount is supplied as an AC bias from the bias power supply 33 for the detection of the toner remaining amount. The detector 30 is made up of a resistance R and a diode D. An output of the capacitor C1 is taken out as a voltage across the resistance R, and it is half-wave rectified by the diode D. The half-wave rectified voltage is integrated by the integrator 31, which is represented by a capacitor C2, for conversion to a DC voltage.

In the comparison unit 32, the DC voltage is compared with a reference voltage E by a comparator F. More specifically, the comparator F compares the output voltage of the integrator 31 with the reference voltage E. If the output voltage is higher than the reference voltage E, the comparator F determines that that the toner is present. If the output voltage is lower than the reference voltage E, the comparator F determines that that the toner is deficient. It is hence required that the reference voltage E is set to be the same as the output voltage of the integrator 31, which is taken when the toner in the developing apparatus is consumed and becomes deficient.

Figure 7:
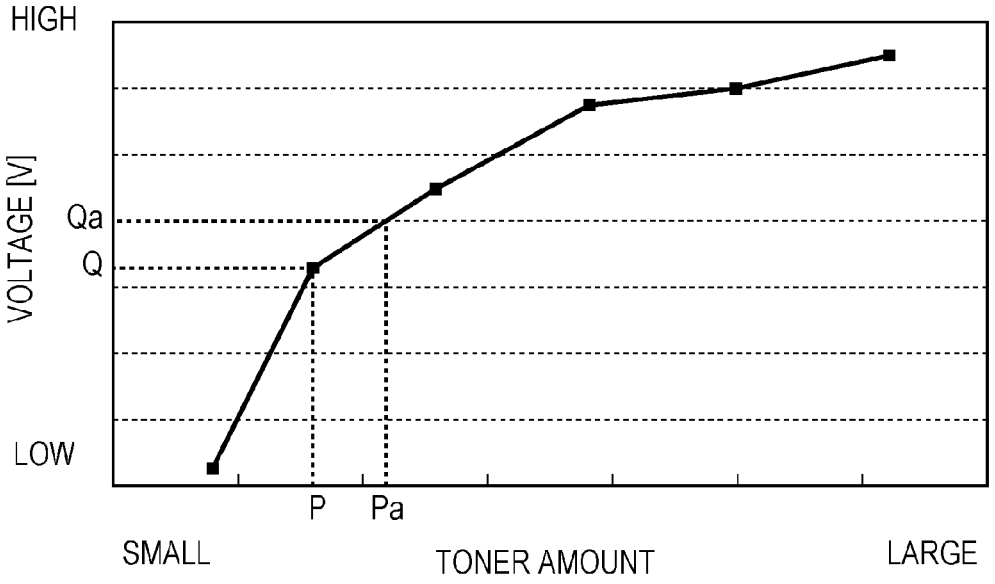
FIG. 7 is a graph plotting the relationship between a detected value and a toner amount.

FIG. 7 plots the relationship between the toner amount in the developing apparatus and change of the output voltage of the integrator 31 in this embodiment. As the toner amount reduces, the output voltage declines. When the toner is gradually consumed and the toner amount reaches a point P in FIG. 7, partial missing of an image occurs on a print. When printing is further continued, an image is totally missed on a print.

In this embodiment, therefore, the determination that the toner is deficient is made at a toner amount Pa that is set in consideration of a margin, which corresponds to 10 sheets of solid black images, with respect to the toner amount P at which the partial missing of the image occurs. Accordingly, control for determining the deficiency of the toner in the developing apparatus is performed by setting the output voltage of the integrator 31 at the toner amount Pa to be the reference voltage E. When the remaining amount detection unit 100*a* determines that the toner is deficient, the controller 100 provides an alarm indication, e.g., "toner deficiency", on the display unit 300*a* of the manipulating portion 300 in the relevant developing apparatus. Control for stopping the image formation may also be executed. As an alternative, the replacement timing of the developing apparatus may be informed to the user.

<Detection of Toner Remaining Amount in Full-Color Image Formation>

The detection of the toner remaining amount in full-color image formation (second detection mode) in this embodiment will be described below with reference to FIG. 8.

Figure 8:
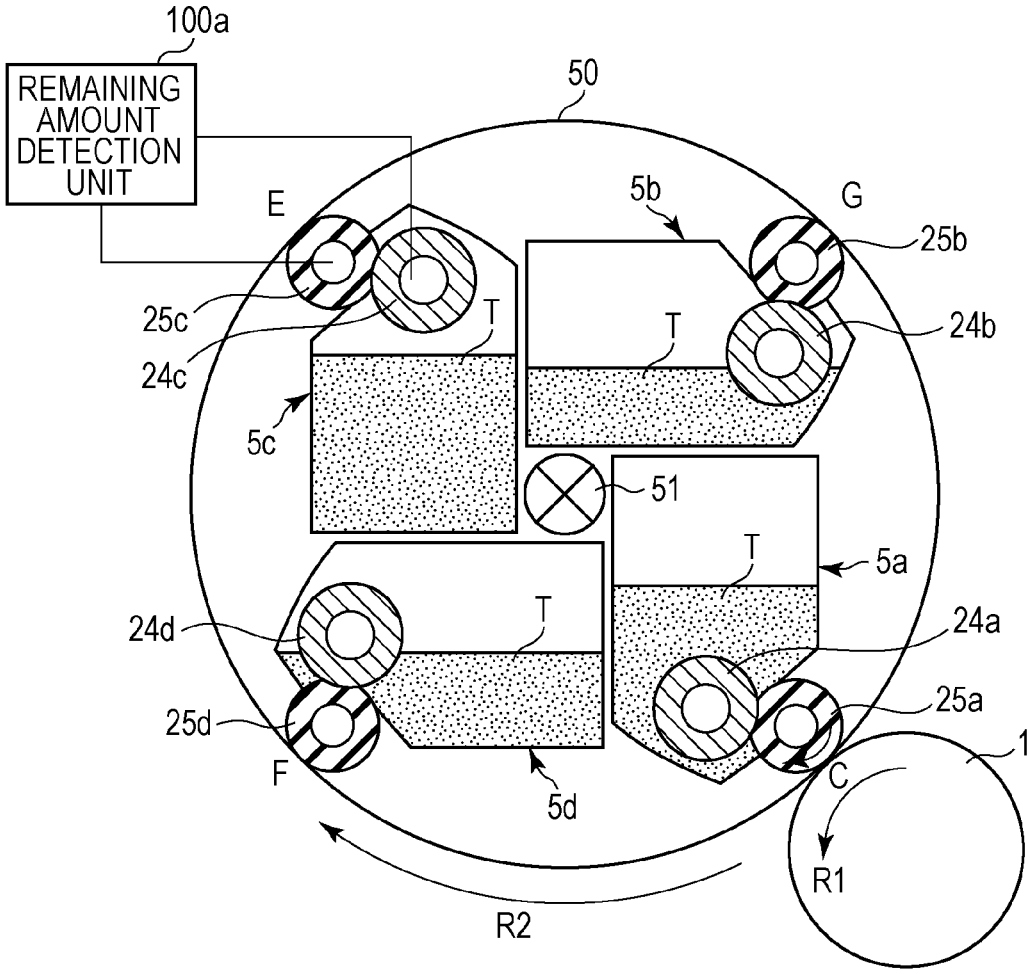
FIG. 8 is a schematic view illustrating relative positions of a rotary, the developing apparatuses, and a drum during full-color image formation.

FIG. 8 illustrates the relative positional relationship among the developing apparatuses 5*a* to 5*d*, the rotary 50, and the drum 1 when the yellow developing apparatus 5*a* is executing the developing operation. The yellow developing apparatus 5*a* is executing the developing operation, which has been described in <Overall Construction of Exemplary Image Forming Apparatus>, at the position C. At that time, the cyan developing apparatus 5*c* is positioned at the position E in the inverted state. In parallel to the developing operation by the yellow developing apparatus 5*a*, the remaining amount detection unit 100*a* detects the electrostatic capacitance in the cyan developing apparatus 5*c* to perform the detection of the toner remaining amount.

After the end of the developing operation of the yellow developing apparatus 5*a*, the controller 100 rotates the rotary 50 through 90° in the direction denoted by the arrow R2 in FIG. 8, and the magenta developing apparatus 5*b* starts the developing operation. At that time, as in the developing operation of the yellow developing apparatus 5*a*, the remaining amount detection unit 100*a* detects the toner remaining amount in the black developing apparatus 5*d* at the position E.

Thereafter, the detection of the toner remaining amount in each of the yellow developing apparatus 5*a* and the magenta developing apparatus 5*b* are performed in a similar manner in parallel to the developing operation, respectively, when the developing operation of the cyan developing apparatus 5*c* is performed and when the developing operation of the black developing apparatus 5*d* is performed.

Thus, by simultaneously performing the developing operation of one developing apparatus and the detection of the toner remaining amount in another developing apparatus, which apparatuses are positioned opposite to each other, the detection of the toner remaining amount can be successively performed for the individual developing apparatuses in the full-color image formation without especially preparing an opportunity to detect the toner remaining amount.

<Detection of Toner Remaining Amount in Monochromatic Color Image Formation>

Figure 10:
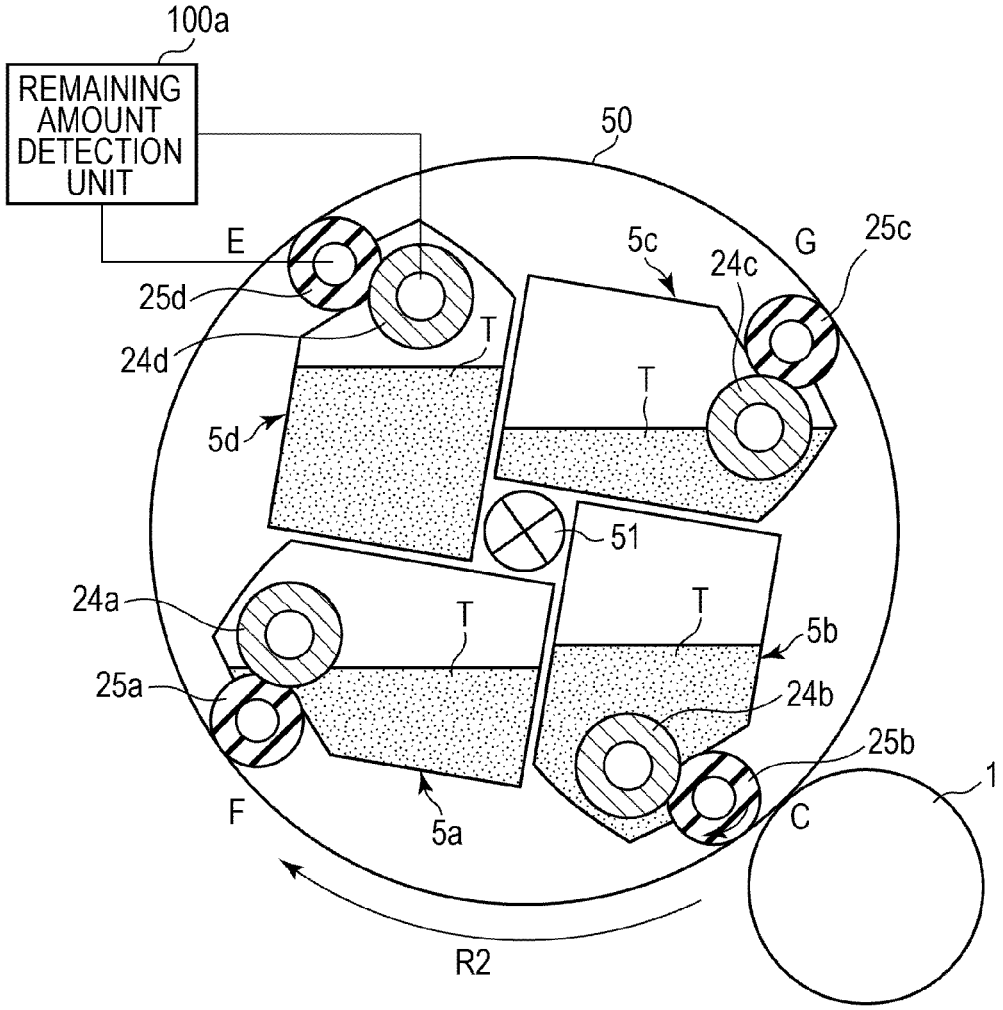
FIG. 10 is a schematic view (No. 1) illustrating relative positions of the rotary, the developing apparatuses, and the drum when detection of a toner remaining amount is executed in a monochromatic mode.
Figure 11:
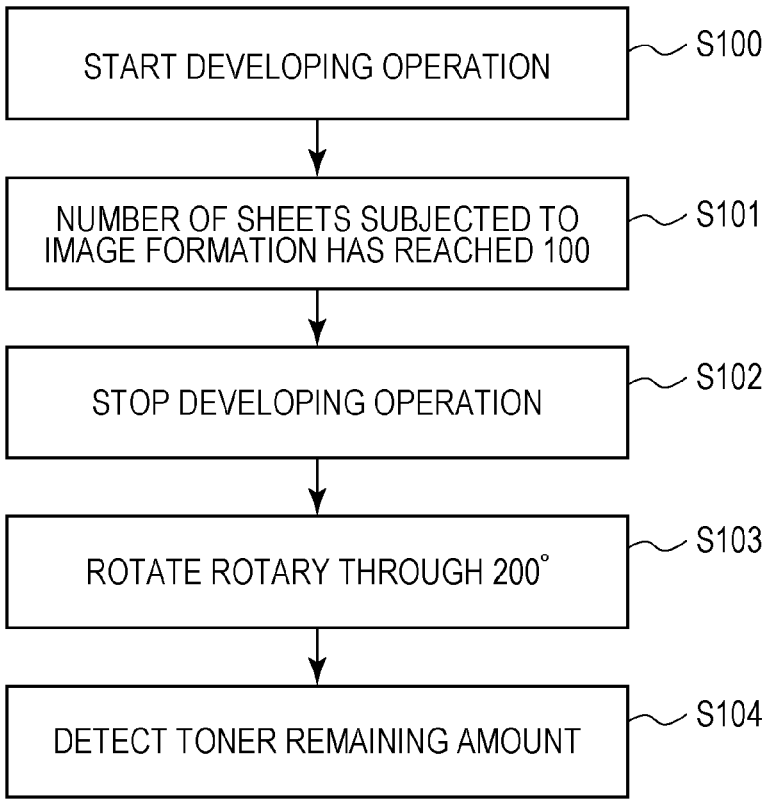
FIG. 11 is a flowchart for the detection of the toner remaining amount in the embodiment.

The detection of the toner remaining amount in monochromatic image formation (first detection mode) in this embodiment will be described below with reference to FIGS. 9 and 10 following a flowchart of FIG. 11.

Figure 9:
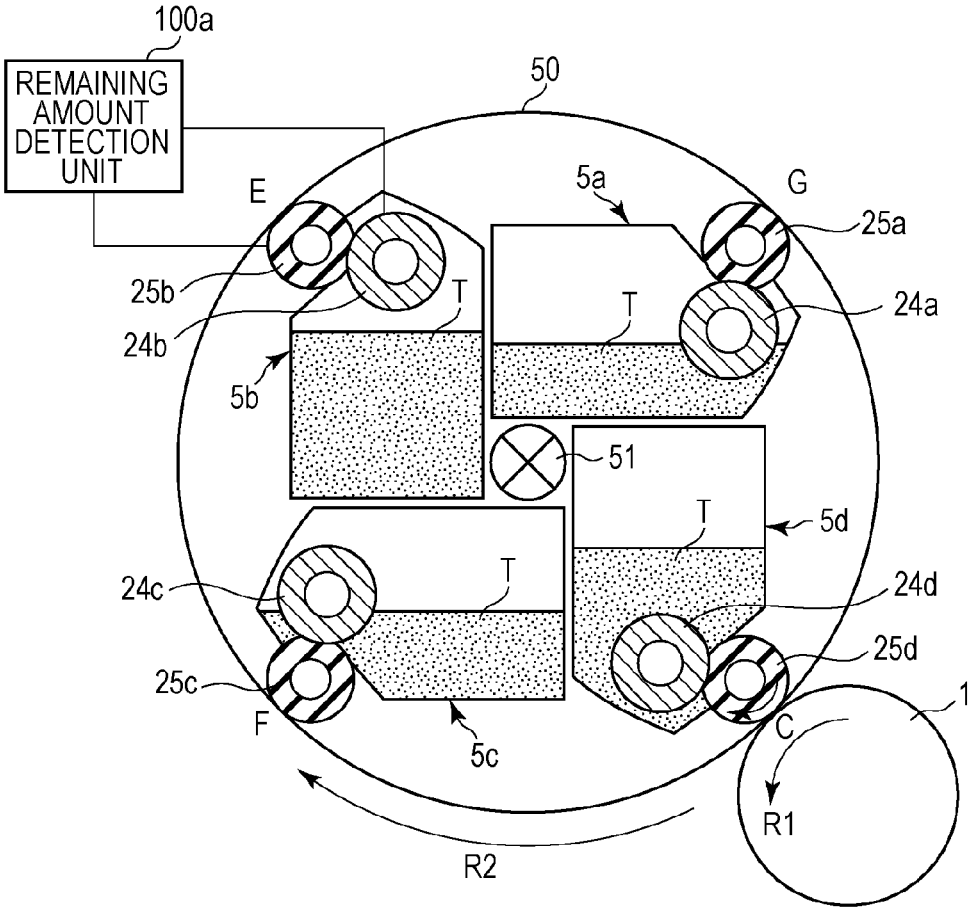
FIG. 9 is a schematic view illustrating relative positions of the rotary, the developing apparatuses, and the drum during monochromatic image formation.

FIG. 9 illustrates the relative positional relationship among the developing apparatuses 5*a* to 5*d*, the rotary 50, and the drum 1 when the image forming operation is executed in the black monochromatic mode. First, the black developing apparatus 5*a* starts the developing operation, which has been described in <Overall Construction of Exemplary Image Forming Apparatus>, at the position C, i.e., at the development position (S100). In parallel, the controller 100 counts the number of sheets on which images have been formed in the monochromatic mode. When the number of sheets on which images have been formed in the monochromatic mode reaches a predetermined value (S101), the controller 100 stops the developing operation (S102). The predetermined value is set to 100 in the image forming apparatus of this embodiment.

To detect the amount of the toner remaining in the developing apparatus 5*d*, the controller 100 rotates the rotary 50 through 200° in the direction denoted by the arrow R2 in FIG. 9, and the black developing apparatus 5*d* is moved to the position where the detection of the toner remaining amount is enabled (i.e., the position advanced through 20° from the position E) (S103). After the movement of the black developing apparatus 5*d*, the remaining amount detection unit 100*a* detects the amount of the toner remaining in the black developing apparatus 5*d* (S104). FIG. 10 illustrates the state after the black developing apparatus 5*d* has been moved to the position advanced through 20° from the position E. The black developing apparatus 5*d* at that time is in the above-mentioned third posture, and the toner is not present around the applying roller 24. Therefore, the toner remaining amount can be detected without being affected by the toner density.

Further, because the magenta developing apparatus 5*b*, positioned opposite to the black developing apparatus 5*d*, is stopped at the position that is advanced through 20° downstream in the rotating direction of the rotary from the position C, i.e., from the development position, the developing roller 25*b* of the magenta developing apparatus 5*b* is in a state spaced from the drum 1. At that time, the developing roller 25*b* of the magenta developing apparatus 5*b* and the drum 1 are both not required to be driven. Hence, the controller 100 makes control such that the developing roller 25*b* and the drum 1 are held in states where their rotations are stopped.

After the end of the detection of the toner remaining amount in the black developing apparatus 5*d*, the controller 100 rotates the rotary 50 again to be ready for the next image formation. Be it noted that, in this embodiment, the developing roller 25*b* of the magenta developing apparatus 5*b* is in the state spaced from the drum 1 during a period from the stop to the restart of the rotary 50 before and after the detection of the toner remaining amount. As a result, the magenta toner is prevented from being undesirably moved onto the drum 1.

In the image forming apparatus of this embodiment, as described above, during the full-color image formation in which the developing operation and the detection of the toner remaining amount in two developing apparatuses 5 positioned opposite to each other, the developing operation at the position C and the detection of the toner remaining amount at the position E are simultaneously performed in parallel. Accordingly, the detection of the toner remaining amount can be successively performed for the individual developing apparatuses without especially preparing an opportunity to detect the toner remaining amount.

In the monochromatic mode where the developing apparatus in the opposite position does not perform the developing operation during the detection of the toner remaining amount, the detection of the toner remaining amount is performed at the position where the rotational angle of the rotary 50 is further advanced through 20° from the position for detecting the toner remaining amount in the full-color image formation (i.e., from the position E). During the measurement of the electrostatic capacitance, therefore, the developing roller 25 of the developing apparatus (e.g., the magenta developing apparatus 5*b* in this case) positioned opposite to the developing apparatus, for which the detection of the toner remaining amount is performed, is in the state spaced from the drum 1. As a result, when the rotary 50 is restarted after the measurement of the electrostatic capacitance, the toner is prevented from being undesirably moved onto the drum 1.

At the position where the rotational angle of the rotary 50 is further advanced through 20° from the position E, the black developing apparatus 5*d* is in the above-mentioned third posture in which the toner is not present around the applying roller 24 due to natural dropping in the gravitational direction. Therefore, the electrostatic capacitance can be detected without suffering from a variation in the detected value, which may be caused with change of the toner density.

While, in this embodiment, the position for detecting the toner remaining amount in the monochromatic mode is set to the position where the rotational angle of the rotary 50 is further advanced through 20° from the position for detecting the toner remaining amount in the full-color image formation (i.e., from the position E), the former position is not limited to the illustrated one because it is just required that the developing roller 25 of the developing apparatus at the opposite position is spaced from the drum 1.

Figure 12:
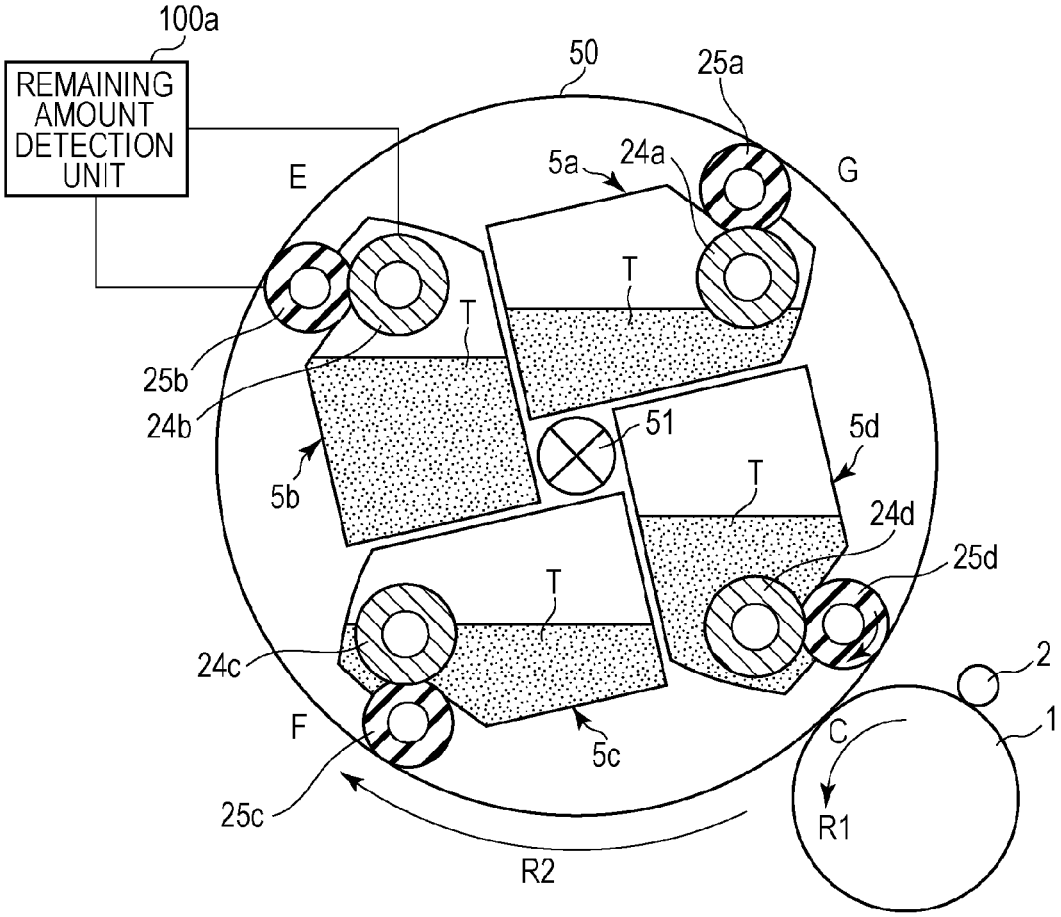
FIG. 12 is a schematic view (No. 2) illustrating relative positions of the rotary, the developing apparatuses, and the drum when the detection of the toner remaining amount is executed in the monochromatic mode.
Figure 13:
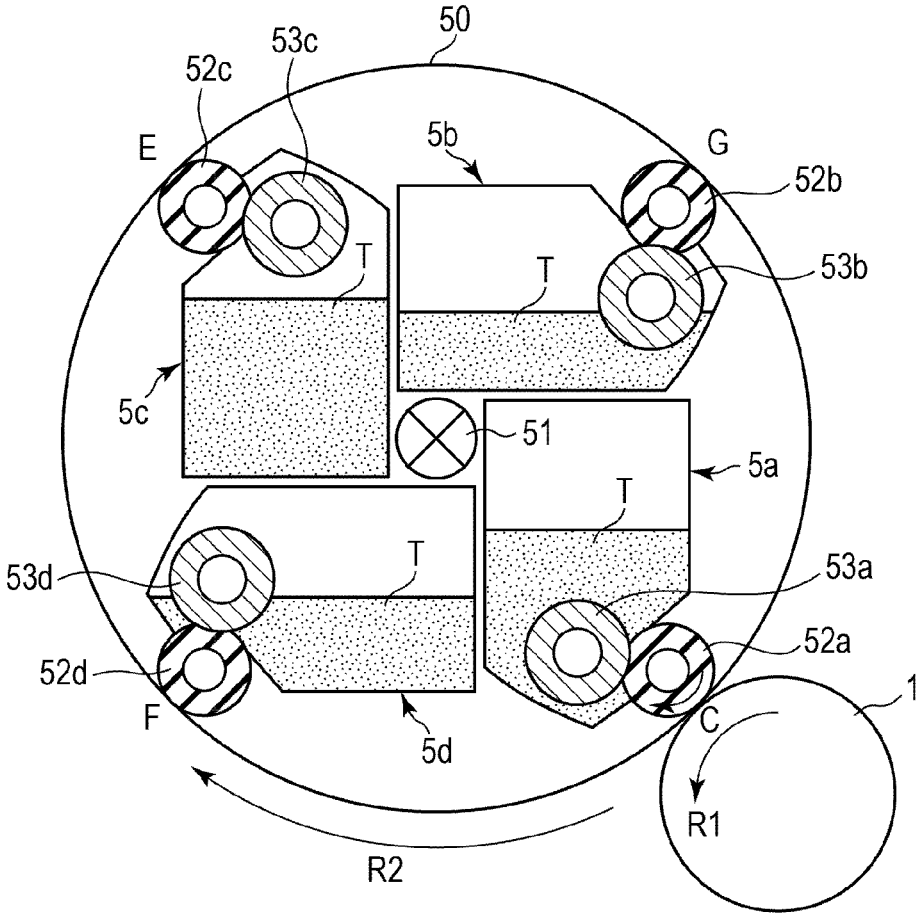
FIG. 13 is an explanatory view of a related art.

A similar advantage can also be obtained, for example, by setting the position for detecting the toner remaining amount in the monochromatic mode to a position where the rotational angle of the rotary 50 is 20° before the position for detecting the toner remaining amount in the full-color image formation (i.e., from the position E). FIG. 12 illustrates the relative positional relationship among the rotary 50, the developing apparatuses 5*a* to 5*d*, and the drum 1 when the amount of the toner remaining in the developing apparatus 5*d* is detected at the position where the rotational angle of the rotary 50 is 20° before the position for detecting the toner remaining amount in the full-color image formation (i.e., from the position E).

However, when the detection of the toner remaining amount is performed at the position before the position E, the developing roller 25*b* for magenta passes the drum 1 immediately after the rotary 50 is rotated again subsequent to the detection of the electrostatic capacitance in the developing apparatus 5*d*. To prevent the magenta toner from being uselessly moved onto the drum 1 for undesired development, therefore, the drum 1 needs to be brought into the state charged by the charging roller 2 at the time the developing roller 25*b* for magenta passes the drum 1. This necessitates such control that the developing roller 25*b* for magenta passes the position C after the surface of the drum 1, which is charged by the charging roller 2, has reached the position where it contacts with the developing roller 25*b* for the development. For that reason, some wait time is required until the rotation of the rotary 50 is resumed.

In the embodiment, the detection of the toner remaining amount has been described, by way of example, in connection with the detection of the toner remaining amount in the monochromatic mode where one developing apparatus positioned opposite to another developing apparatus, for which the toner remaining amount is to be detected, does not perform the developing operation during the detection of the toner remaining amount. However, the timing of detecting the toner remaining amount in the monochromatic mode is not limited to the illustrated one, and the above-described operation is also applicable to, e.g., the case where the toner remaining amount in desired one of the developing apparatuses is detected at an arbitrary timing.

As described above, the image forming apparatus of this embodiment has, as a mode for detecting the toner remaining amount, two modes in which the detection of the toner remaining amount is performed at different positions. In other words, there are a second remaining-amount detection mode (second detection mode) that is typically executed in the full-color image formation where, during the detection of the toner remaining amount, the developing roller 25 of one developing apparatus 5 positioned opposite to another developing apparatus 5, for which the toner remaining amount is to be detected, comes into contact with the drum 1, and a first remaining-amount detection mode (first detection mode) that is typically executed in the monochromatic image formation where the relevant developing roller 25 stands by in the state spaced from the drum 1. In the second remaining-amount detection mode, the developing operation of the developing apparatus and the detection of the toner remaining amount are performed at the same time, whereby the detection of the toner remaining amount can be performed for the individual developing apparatuses without especially preparing an opportunity to detect the toner remaining amount. In the first remaining-amount detection mode, when the rotary 50 is restarted after detecting the toner remaining amount in the developing apparatus 5, the toner can be prevented from being undesirably moved onto the drum 1 from the developing apparatus that is not used in the image formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-184282 filed Aug. 19, 2010, which is hereby incorporated by reference herein in its entirety.

What is claimed is:

1. An image forming apparatus comprising:

an image bearing member configured to bear a latent image on a surface thereof;

a plurality of developing apparatuses each including a developer containing chamber containing a developer, a developer bearing member including a first electrode member, the developer bearing member being configured to bear and convey the developer to the image bearing member and to develop the latent image, and a developer supply member arranged inside the developer containing chamber in contact with the developer bearing member and including a second electrode member, the developer supply member being configured to supply the developer to the developer bearing member;

a rotatable holding unit configured to hold the developing apparatuses and to rotationally move each of the developing apparatuses to a development position where the developer bearing member and the image bearing member are contacted with each other, and detection positions where the developer having deposited in a nip between the developer bearing member and the developer supply member at the development position is dropped from the nip; and a detection device configured to execute detection modes of detecting electrostatic capacitance between the first electrode member and the second electrode member at the detection positions, and wherein one detection position is in a state where all of the developing apparatuses are not located at the development position and another detection position is in a state where one of the developing apparatuses is located at the development position.

2. The image forming apparatus according to claim 1, wherein when a monochromatic mode of forming an image by using only one of the developing apparatuses is executed, the detection device executes the first detection mode and detects the electrostatic capacitance in the developing apparatus that is used in the monochromatic mode.

3. The image forming apparatus according to claim 1, wherein the detection device is able to execute a second detection mode of detecting the electrostatic capacitance in the developing apparatus that is located at the detection position, when any of the developing apparatuses performs development at the development position.

4. The image forming apparatus according to claim 3, wherein when a full-color mode of forming an image by using the developing apparatuses is executed, the detection device executes the second detection mode.

5. The image forming apparatus according to claim 1, wherein when the first detection mode is executed, the developing apparatus located to face the image bearing member is positioned downstream of the development position in a rotating direction of the holding unit.

6. The image forming apparatus according to claim 1, wherein the developing apparatuses opposed to the image bearing member at the one detection position are located on a downstream side of the development position in a rotation direction of the rotatable holding unit.

7. The image forming apparatus according to claim 1, wherein the developer containing chamber of one of the plurality of developing apparatuses has an opening.

8. The image forming apparatus according to claim 1, wherein a developer bearing member is arranged in the opening of the developer containing chamber.

9. The image forming apparatus according to claim 1, wherein a foamed layer is around the second electrode member.

* * * * *